US005648907A

United States Patent [19]

Taijonlahti et al.

[11] Patent Number: 5,648,907

[45] Date of Patent: *Jul. 15, 1997

[54] PRODUCTION METHOD FOR HANDLING PLATES CUT OUT OF A PLATE BLANK FOR FURTHER PRODUCTION

[75] Inventors: Jorma Taijonlahti, Kangasto; Lauri Kohtamäki, Kauhava, both of Finland

[73] Assignee: Lillbackan Konepaja Oy, Kauhava, Finland

[ * ] Notice: The term of this patent shall not extend beyond the expiration date of Pat. No. 5,317,516.

[21] Appl. No.: 239,556

[22] Filed: May 9, 1994

Related U.S. Application Data

[63] Continuation of Ser. No. 717,897, Jun. 19, 1991, Pat. No. 5,317,516.

[30] Foreign Application Priority Data

Jun. 19, 1990 [FI] Finland ..... 903072

[51] Int. Cl.[6] ..... G06F 19/00

[52] U.S. Cl. ..... 364/468.02; 364/468.19; 198/576; 198/577

[58] Field of Search ..... 364/468, 478, 364/479, 468.01, 468.02, 468.03, 468.13, 468.19, 468.2, 469.01; 198/460, 572, 575, 576, 577, 579; 206/586, 587, 644

[56] References Cited

U.S. PATENT DOCUMENTS

| | | | |
|---|---|---|---|
| 3,877,332 | 4/1975 | Roch . | |
| 4,520,933 | 6/1985 | Reiff . | |
| 4,700,308 | 10/1987 | Jones . | |
| 4,833,954 | 5/1989 | Jenkner . | |
| 4,998,206 | 3/1991 | Jones et al. . | |
| 5,317,516 | 5/1994 | Taijonlahti et al. | 364/468 |

FOREIGN PATENT DOCUMENTS

| | | |
|---|---|---|
| 0 326 001 | 1/1989 | European Pat. Off. . |
| 2 040 779 | 4/1979 | United Kingdom . |

*Primary Examiner*—Paul P. Gordon
*Assistant Examiner*—Thomas E. Brown
*Attorney, Agent, or Firm*—Pollock, Vande Sande & Priddy

[57] ABSTRACT

The invention relates to a production method for handling plates to be cut out of a plate blank. The production method is effected via a production system by carrying out a variety of working operations in an integrated manner, at a so-called plate working center, with a shearing mechanism, an unloading and handling mechanism, as well as a single or multi-section conveyor mechanism serving as a buffer conveyor storage therebetween, the mechanisms being computer controlled.

26 Claims, 3 Drawing Sheets

PRODUCTION METHOD FOR HANDLING PLATES CUT OUT OF A PLATE BLANK FOR FURTHER PRODUCTION

This is a continuation of application Ser. No. 717,897, filed on Jun. 19, 1991, now U.S. Pat. No. 5,317,516.

FIELD OF THE INVENTION

The present invention relates to a production method for handling plates cut out of a plate blank, whereby the application of said production method comprises the following steps a plate blank is chopped by means of a shearing mechanism into plates of a predetermined shape, whereby the plates successively cut out of a plate blank are transferred onto a conveyor assembly for carrying the cut-off plates to an unloading end, wherein an unloading and sorting mechanism is operated for unloading for further production the cut-off plates carried on said conveyor assembly.

BACKGROUND OF THE INVENTION

The computer-aided NC programming is today's routine in the programming of plate working machines and the programming of NC control is carried out by means of a separate computer or terminal, separately from a working machine, said working machine operating normally during the course of programming. The programming of plate working centers and particularly integrated systems (FMS, FMC), wherein a single system includes a plurality of combined working machines performing a variety of operations, employs currently nearly exclusively purpose-designed software systems which facilitate a simple programming of effective manufacturing techniques (multiplication, nesting etc.).

In the latest programming systems, the trend of development has proven to be a combination of computer-aided design and programming by means of a so-called DAD/DAM system, whereby the actual NC programs required for operations are developed on the basis of the geometric data compiled in CAD planing partly during the course of planning or the development thereof can be automated for a relatively easy performance. This type of integrated CAD/CAM system is essentially better than a software package compiled from a plurality of individual programs, since there is no need for the transfer of files between different programs.

A further production developement based on a so-called JOT (just on time) principle and the automatic flexible manufacturing technique such as FMS (Flexible Manufacturing System) required thereby, which can also be linked with a CAD/CAM system, has led to the fact that the above-described earlier development has primarily been the result of the development of working machines and automatic data processing and the starting point or basis has not been the rationalization according to the real requirements of production and manufacturing. The aim of such JOT-principle based flexible manufacturing system, particularly in plate working technique, is the integration of various plate working operations (punching, bending, shearing, welding etc.) as a single centrally controllable production system. In JOT production, the flexible automated production equipment is used to manufacture products for just a proper purpose (JOT), i.e. just the amount needed for a particular manufacturing batch. The intention is to keep manufacturing batches as small as possible as it is desirable to minimize the capital tied in unfinished production.

This leads to smaller series but, on the other hand, it is necessary to produce even small series as efficiently and economically as large series. This requires an automated passage for data and material. In the production of plate articles, problems are particularly associated with the material handling system on the unloading side of punching and shearing units, since the system should be capable of sorting and stacking pieces arriving rapidly in random order in their own stacks. The system must also be capable of grouping the pieces according to the proper sizes thereof for subsequent working operations by collecting segments made of various plate blanks into groups (e.g. a single pallet for all the segments of a particular article intended for edge trimming etc.).

The cutting or shearing of a plate blank and the handling of plates cut out of it for further production or intermediate storage can be currently carried out by using shearing, conveying, inloading and sorting mechanisms which are programmable and linked with a CAD/CAM system and apply said flexible manufacturing system (FMS). One-problem of the current solutions has however proved to be a different momentary operating speed of the above-mentioned mechanisms, whereby the efficiency of the total operation has been determined according to a mechanism having a slower operating speed. A momentary difference in operating speed refers to the fact that, although the mechanisms have nominal operating speeds that are nearly matching, the cutting or shearing of individual plates and the transfer thereof onto a conveyor between mechanisms takes place within a fraction of the time required for removing a corresponding plate from said conveyor. Accordingly, the cutting mechanism requires a setting-up and transitional period for a fresh plate, something that is not required by a continuous-action unloading and handling mechanism.

SUMMARY OF THE INVENTION

An object of a production method of this invention is to provide a decisive improvement on the above drawback and, thus, to raise the technical level of the prior art. In order to achieve this object, a production method of the invention is principally characterized in that said said conveyor mechanism and a shearing mechanism as well as an unloading and handling mechanism associated therewith are set up as a flexible production system in a manner that said conveyor mechanism serves to receive the periodically cut-out plates sheared during a shearing operation effected by the shearing mechanism, said conveyor mechanism serving as a buffering conveyor storage for compensating a momentary operating speed difference between the shearing mechanism as well as the unloading and handling mechanism.

The most important benefits gained by a production method of the invention include e.g. an improved control and handling essential in terms of overall operation as well as a possibility of grouping and stacking the cut-off pieces at a plurality of positions, all without restricting the operating speed of the other mechanisms. One concrete result is also a reduction of the throughput time.

The other non-independent claims set forth preferred embodiments for a production method of the invention.

BRIEF DESCRIPTION OF THE DRAWINGS

The invention will be described in detail in the following specification with reference made to the accompanying drawings, in which.

DETAILED DESCRIPTION OF THE INVENTION

Figure 1:
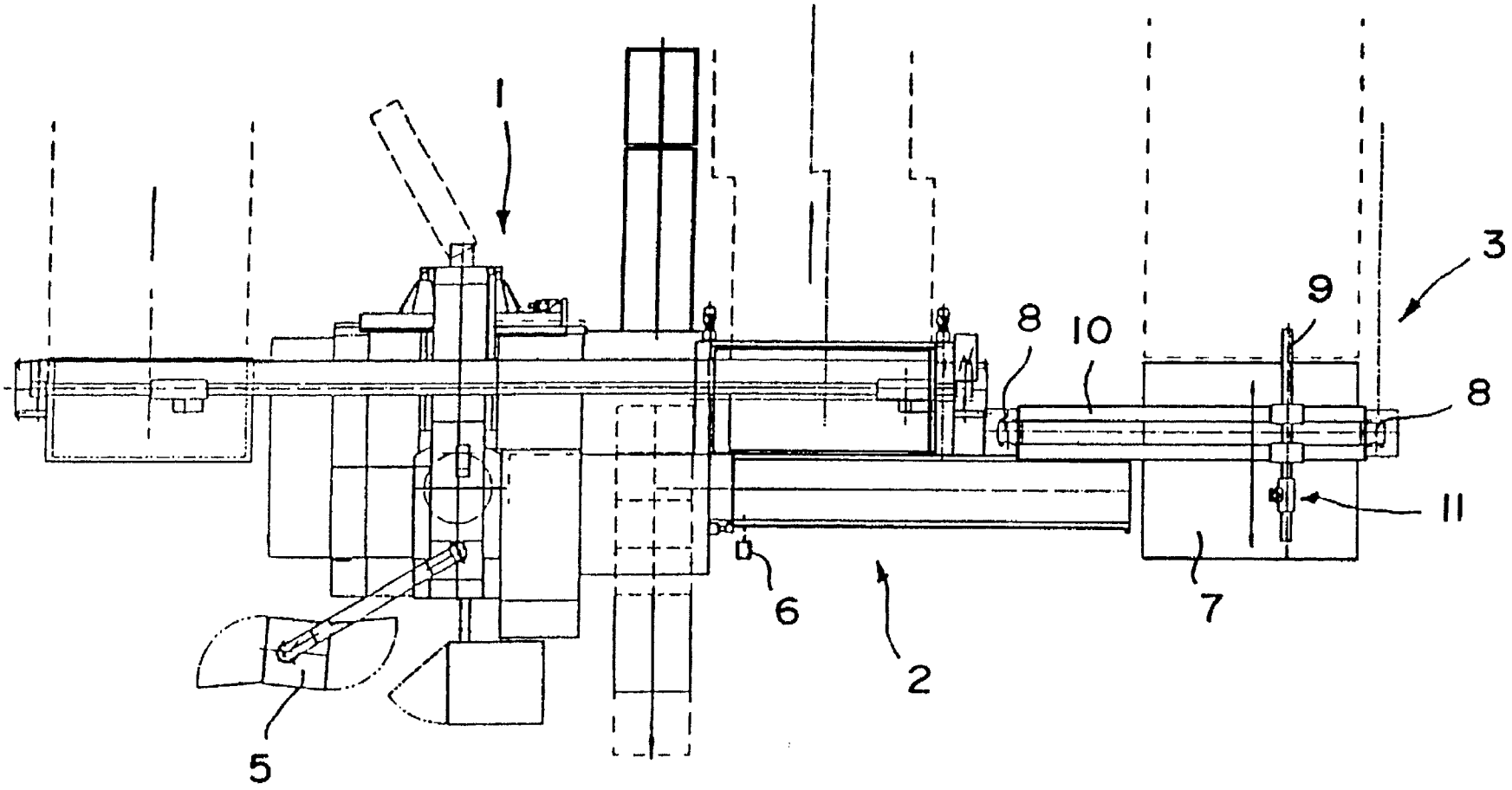
FIG. 1 shows an example of one embodiment of a production system of the invention in a plan view.
Figure 2:
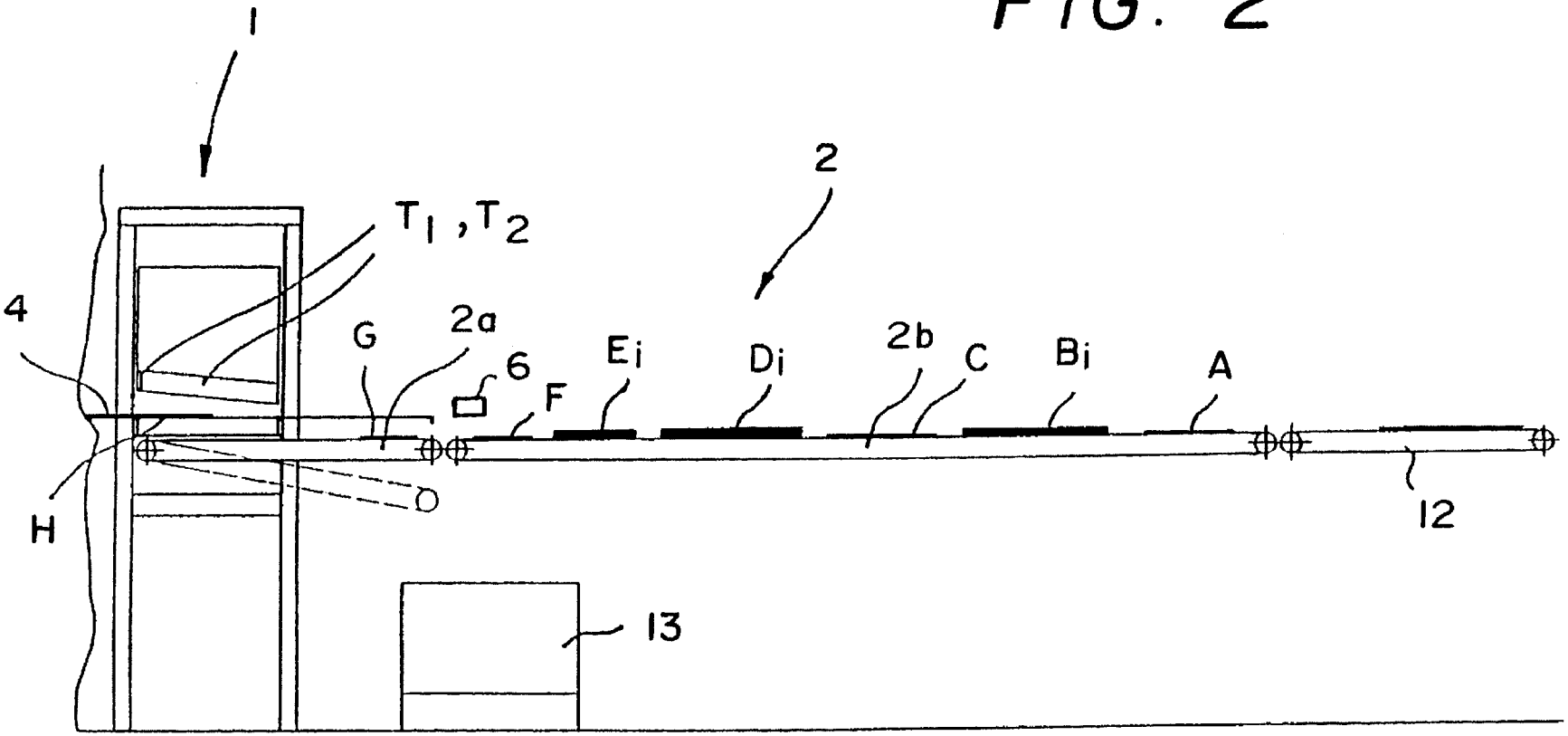
FIG. 2 shows an example of one embodiment of a production system of the invention in a side view.

In the embodiment shown in FIGS. 1 and 2, a production method of the invention for carrying out a variety of plate working operations by means of an integrated production system, i.e. a so-called plate working center, comprises a shearing mechanism 1 and an unloading and handling mechanism 3 as well as a single- or multi-section conveyor mechanism 2 serving as a so-called conveyor storage therebetween, the functions of the latter being centrally controlled by a computer control 5. Thus, the control of conveyor mechanism 2 is preferably effected by means of a separate control means, e.g. light-activated sensor 6, mounted in connection with the inlet end of conveyor mechanism 2 and linked with the computer control. The termination of a shearing operation is adapted to activate said conveyor mechanism 2 and the sensor is adapted to halt conveyor mechanism 2 after a plate/plate stack has passed by said sensor 6.

Figure 3B:
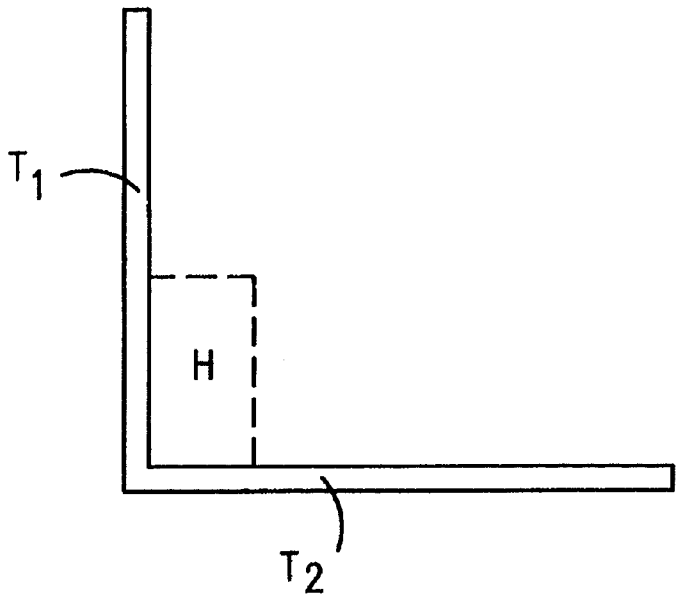
FIG. 3 shows an example of a plate blank to be cut according to a predetermined pattern as well as the blade of a so-called angular cutter.
Figure 3A:
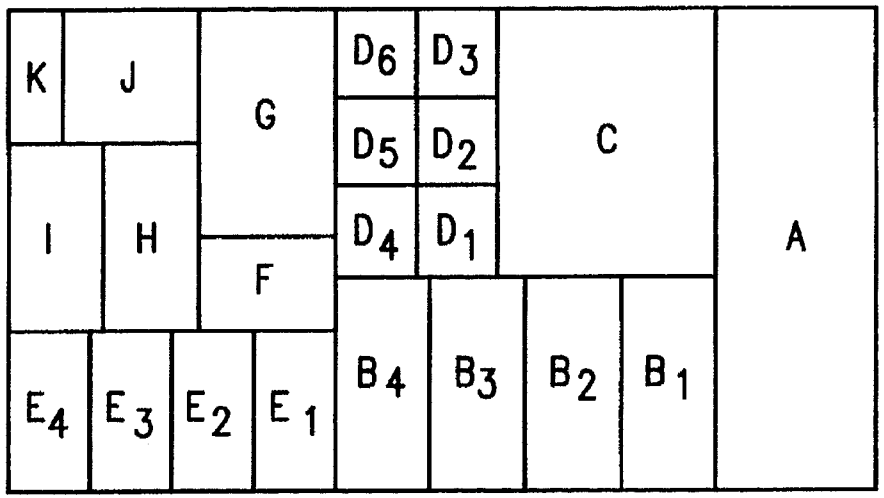

The shearing mechanism 1 is preferably designed by applying a so-called angular cutting principle wherein, as shown in FIG. 3, the cutting tool comprises two blades T1 and T2 extending perpendicularly to each other. As for the shearing mechanism and its operating principle, reference is made to the publication U.S. Pat. No. 3,877,332.

On the other hand, the unloading and handling mechanism 3 is preferably embodied by using a manipulator or a robot operating on a so-called portal principle, comprising e.g. a gripping means 11 which is movable relative to supporting legs 8 and maneuvering assemblies 9, 10 and engages mechanically the plates to be carried forward.

In practice, the operation of a plate working center as shown in FIGS. 1 and 2 proceeds in a manner that, preferably in association with either an automatic overall system or with a system involving merely a current plate working center, said shearing mechanism 1 is supplied with a plate blank 4 (FIG. 3), which is provided with cut-off plate configurations A–K preferably by means of a so-called grouping program included in said computer control 5 of the plate working center while possibly applying also an optimum exploitation of the surface area of a plate blank.

As for a plate blank 4 shown in FIG. 3, the shearing operation in shearing mechanism 1 is effected by applying said angular cutting principle by cutting off pieces of the plate blank in the illustrated alphabetical order A–K. The angular cutting is particularly preferred in the present embodiment for the reason that the dissection of an entire plate blank 4 can be carried out as successive shearing operations without re-setting a plate blank during the course of a shearing operation, as often required by other similar cutting methods, as well as without repeated maneuvering of a plate blank, whereby the mode of cutting provides a concrete possibility of achieving both the optimum consumption of a plate material and the reduction of a throughput time.

A cut-off plate, e.g. A, advances after a shearing operation onto a conveyor mechanism 2 which is preferably controlled according to a proceeding cutting operation and is activated and, as monitored by sensor 6 or a similar control element, carries plate A on conveyor mechanism 2 over a distance substantially exceeding the length of plate A in the longitudinal direction of the conveyor, whereafter said conveyor mechanism 2 comes to a halt as sensor 6 or a like control element detects that plate A has advanced a necessary distance to wait for a next plate B etc.

The successively cut-off plates A–K laid successively on conveyor mechanism 2 are carried upon a periodic driving of conveyor mechanism 2 to the unloading end of conveyor mechanism 2 for carrying and setting them onto a receiving conveyor 12, whereby said unloading and handling mechanism 3 is operated to carry them in programmed grouping and stacking fashion further onto a transport carrier, e.g. a standard pallet 7, for further production or temporary storage. The successively cut-off plates of equal size can preferably be laid in a stack on conveyor mechanism 2 by maintaining said conveyor mechanism 2 stationary during the above shearing operations, as shown in FIG. 2 (stacks B, D and E). In the present embodiment, the unloading and handling mechanism 3 operating on a portal principle is preferred due to the fact that it requires relatively little space and is reliable in operation. Said gripping means 11 for the above-type of unloading and handling meachanism may also comprise a vacuum-based gripper, such as a suction pad.

It is obvious that the invention is by no means limited to the above embodiment but major modifications can be made to it within the basic concept. First of all, the illustrated plate working center can be integrated or associated with other working operations as well, such as punching, press bending etc. Said conveyor mechanism 2 can be designed as a two- or multi-section assembly 2*a*, 2*b* (FIG. 2) in a manner that at least a first conveyor 2*a* can be tilted to an inclined position shown by dash-and-dot lines in FIG. 2, wherein its trailing edge lies below the operative level of conveyor mechanism 2 for removing reject material and/or small pieces or the like from conveyor mechanism 2 onto a receiving structure 13, such as pallets or belt or like conveyors therebelow, immediately following a cutting operation. Thus, a sensor 6 or a like control element is mounted in alignment with the forward edge of second conveyor 2*b*, said second conveyor 2*b* being stationary during the course of an above-mentioned removal action. It is further preferred to arrange a computer control 5, designated to a particular plate working center and applying flexible manufacturing technique, in association with a design-service data processing system (CAD/CAM) for carrying the data from design to manufacturing automatically in digital form.

We claim:

1. A system for handling plates cut from a plate blank comprising:

a cutting mechanism for cutting a plate blank into plates having different predetermined sizes or shapes;

conveyor means being operated during said cutting operation for receiving and transporting said plates successively cut from said plate blank to an unloading location;

unloading and sorting means for vertically placing cut plates of the same size or shape onto the same location on a carrier at said unloading location; and computer means for controlling the operation of said cutting mechanism, said conveyor means and said unloading and sorting means as a flexible production system by using said operated conveyor means as a buffer conveyor storage for compensating momentary differences in the operating speeds of said cutting mechanism and said unloading and sorting means.

2. The system of claim 1, further comprising:

at least one sensing means positioned relative to said conveyor means for providing at least one signal to said computer means to control the operation of said conveyor means.

3. The system of claim 1, wherein said carrier comprises:

a pallet for stackingly receiving plates of the same shape or size cut by said cutting mechanism at a particular position on said pallet such that different stacks of cut plates of respective shapes or sizes are carried by said pallet.

4. The system of claim 1, wherein said conveyor means comprises at least two successive conveyors at least the first one thereof having at least one end movable for removing plates or reject materials from said conveyor means.

5. The system of claim 1, wherein said unloading and sorting means comprises a manipulator or a robot.

6. In a numerically controlled plate manufacture center whereby plates of different sizes or shapes are successively cut from a plate blank, a method of handling said successively cut plates comprising the steps of:

directing each one of said plates cut from said plate blank successively onto a conveyor means;

operating said conveyor means for receiving and transporting said each cut one plate successively to an unloading location; and vertically placing said each cut one plate of the same size or shape successively onto one area of a carrier means positioned at said unloading location, said carrier means adaptable to carry a plurality of stacks of cut plates of different sizes or shapes.

7. The method of claim 6, further comprising the step of:

numerically controlling said directing step, said operating step and said placing step as a flexible production method to improve the handling of said plates.

8. The method of claim 7, wherein said vertically placing of cut plates of same sizes or shapes as respective stacks on said carrier means is effected by an unloading and sorting means in a programmed fashion.

9. The method of claim 7, wherein said vertically placing of cut plates grouped according to plate shapes or sizes is by means of a manipulator or a robot.

10. The method of claim 7, further comprising the step of:

controlling a design-service CAD/CAM system means for facilitating data transfer between design and manufacturing functions.

11. The method of claim 6, further comprising the steps of:

using a shearing mechanism for cutting said plate blank; and using said conveyor means as a buffer conveyor storage for compensating momentary differences in the operating speeds of said shearing mechanism and the placing of said each cut one plate successively onto said carrier means.

12. The method of claim 6, wherein the operation of said conveyor means is controlled by at least one sensing means.

13. The method of claim 6, wherein said conveyor means comprises at least two conveyors, further comprising the step of:

removing from one of said conveyors reject materials or plates.

14. The method of claim 6, further comprising the step of:

subjecting said each cut one plate to other programmed operations including punching operations prior to directing said each cut one plate successively onto said conveyor means.

15. The method of claim 6, wherein the configurations of said plates to be cut from said plate blank is effected by a set of programs linked with hardware for optimally exploiting the surface area of said plate blank.

16. A numerically controlled plate manufacture method comprising the steps of:

utilizing a cutting means to cut successive plates of different sizes or shapes from a plate blank;

directing each of said plates cut from said plate blank successively onto a conveyor means;

operating said conveyor means intermittently for receiving and transporting said each of said cut plates successively to an unloading location; and vertically placing said each cut plates of respective same sizes or shapes successively onto corresponding areas of a carrier means positioned at said unloading location.

17. The method of claim 16, wherein the respective operations of said cutting means and said conveyor means are effected to stack said cut plates of the same shape or size successively on said conveyor means during the course of a shearing operation.

18. The method of claim 16, further comprising the step of:

numerically controlling said utilizing step, said directing step, said operating step and said placing step as a flexible production method to improve the handling of said plates.

19. The method of claim 18, wherein said successive vertically placing of said each of said cut plates of same sizes or shapes as respective stacks on said carrier means is effected by an unloading and sorting means in a programmed fashion.

20. The method of claim 18, further comprising the step of:

controlling a design-service CAD/CAM system means for facilitating data transfer between design and manufacturing functions.

21. The method of claim 18, wherein said successive vertically placing of said each of said cut plates grouped according to plate shapes or sizes is by means of a manipulator or a robot.

22. The method of claim 16, further comprising the step of:

using said intermittently operated conveyor means as a buffer conveyor storage for compensating momentary differences in the operating speeds of said cutting means and the placing of said each of said cut plates successively onto said carrier means.

23. The method of claim 16, wherein the intermittent operation of said conveyor means is controlled by at least one sensing means.

24. The method of claim 16, wherein said conveyor means comprises at least two conveyors, further comprising the step of:

removing from one of said conveyors reject materials or plates.

25. The method of claim 16, further comprising the step of:

subjecting said each of said cut plates successively to other programmed operations including punching operations prior to directing said plates onto said conveyor means.

26. The method of claim 16, wherein the configurations of said plates to be cut from said plate blank is effected by a set of programs linked with hardware for optimally exploiting the surface area of said plate blank.

* * * * *